US007036438B2

(12) United States Patent
Okamoto et al.

(10) Patent No.: US 7,036,438 B2
(45) Date of Patent: May 2, 2006

(54) DESK SYSTEM

(75) Inventors: Atsuo Okamoto, Tokyo-To (JP); Takashi Kunishita, Tokyo-To (JP); Hideki Tachikawa, Tokyo-To (JP); Koichi Wakasugi, Tokyo-To (JP); Tetsuya Matsuda, Tokyo-To (JP)

(73) Assignee: Uchida YoKo Co., Ltd., Tokyo-To (JP)

( * ) Notice: Subject to any disclaimer, the term of this patent is extended or adjusted under 35 U.S.C. 154(b) by 410 days.

(21) Appl. No.: 10/291,388

(22) Filed: Nov. 12, 2002

(65) Prior Publication Data

US 2003/0089283 A1 May 15, 2003

(30) Foreign Application Priority Data

Nov. 12, 2001 (JP) ..... 2001-346613

(51) Int. Cl.
*A47B 13/00* (2006.01)

(52) U.S. Cl. ..... 108/153.1; 108/50.01

(58) Field of Classification Search ..... 108/50.01, 108/50.02, 157.18, 157.1, 23, 153.1; 312/195, 312/196, 223.6
See application file for complete search history.

(56) References Cited

U.S. PATENT DOCUMENTS

| | | | | |
|---|---|---|---|---|
| 4,838,177 | A * | 6/1989 | Vander Park | 108/50.02 |
| 5,186,425 | A * | 2/1993 | Keusch et al. | 108/50.02 |
| 5,289,784 | A * | 3/1994 | Waibel | 108/157.1 |
| 5,357,874 | A * | 10/1994 | Palmer | 108/50.02 |
| 5,522,324 | A * | 6/1996 | van Gelder et al. | 108/50.02 |
| 5,638,759 | A * | 6/1997 | Klugkist | 108/50.02 |
| 6,024,024 | A * | 2/2000 | Favaretto | 108/64 |
| 6,152,048 | A * | 11/2000 | Vander Park | 108/50.02 |
| 6,199,807 | B1 * | 3/2001 | Ilijas | 108/50.02 |
| 6,267,064 | B1 * | 7/2001 | Ostertag et al. | 108/50.02 |
| 6,283,043 | B1 * | 9/2001 | Stern et al. | 108/50.02 |
| 6,397,762 | B1 * | 6/2002 | Goldberg et al. | 108/50.02 |
| 6,415,723 | B1 * | 7/2002 | Kopish et al. | 108/50.02 |
| 6,647,900 | B1 * | 11/2003 | Kopish | 108/50.02 |
| 6,725,784 | B1 * | 4/2004 | Crinion | 108/64 |
| 6,766,748 | B1 * | 7/2004 | Insalaco et al. | 108/50.02 |

FOREIGN PATENT DOCUMENTS

| | | |
|---|---|---|
| DE | 91 10 690 U | 11/1991 |
| DE | 299 03 368 U | 5/1999 |
| EP | 0 765 738 A1 | 2/1996 |
| GB | 1125797 A | 5/1966 |
| WO | WO 95/32644 A | 12/1995 |
| WO | WO 03 037140 A | 5/2003 |
| WO | WO 03/037140 A | 5/2003 |

* cited by examiner

*Primary Examiner*—Jose V. Chen
(74) *Attorney, Agent, or Firm*—Birch, Stewart, Kolasch & Birch, LLP

(57) ABSTRACT

A desk system comprises leg panels of a desired thickness, top board support members each having a top support surface and capable of being fastened to the leg panel such that the top support surface extends above the leg panel, top boards respectively having desired shapes and capable of being fastened to the top support surfaces of the top board support members, and longitudinal beams connecting the adjacent leg panels and forming a trough. Each of the leg panels is a hollow structure having a cut upper corner, an end part of each longitudinal beam is fastened to the cut upper corner. The desk system is capable of being assembled in a desired form.

16 Claims, 13 Drawing Sheets

DESK SYSTEM

BACKGROUND OF THE INVENTION

1. Field of the Invention

The present invention relates to a desk system and, more particularly, to a desk system having a high degree of freedom of arranging top boards in various layouts according to conditions and purposes for uses as desk systems and capable of being easily assembled and recombined.

2. Description of the Related Art

FIG. 23 shows a representative conventional built-up work desk capable of being assembled in an optimum combination, taking into consideration the number of persons that will engage in the work to be carried out on the work desk and the purpose of the work. The work desk is assembled by extending beams b between legs a set up on the floor and fastening top boards c to the beams b with screws. When it is desired to arrange the top boards c in a plane L-shaped arrangement to form an L-shaped work desk, a circular beam b' having the shape of a circular arc in a plan view is extended between the middle legs a, and a sectorial top board c' is fastened to the circular beam b'.

This conventional built-up work desk needs beams of shapes conforming to a desired layout and, when the layout is changed, needs parts conforming to a new layout. Thus, the parts of the conventional built-up work desk cannot commonly be used for forming work desks of different layouts, and hence the built-up work desk is inevitably costly. Since fastening members, such as bolts, are necessary for fastening the beams b to the legs a and fastening the top boards c to the beams b, assembling the built-up work desk needs much time and labor.

SUMMARY OF THE INVENTION

Accordingly, it is an object of the present invention to provide a desk system capable of readily coping with changes in the layout of top boards by commonly using parts for forming desk systems of different layouts, and of easily assembled and recombined.

Another object of the present invention is to provide a desk system facilitating installing screen panels for separating adjacent desk sections and/or opposite desk sections of the desk system, and laying cables for supplying power to office automation equipment through the desk sections.

According to a first aspect of the present invention, a desk system capable of being assembled in a desired form comprises: leg panels of a desired thickness; top board support members each having a top support surface and capable of being fastened to the leg panel such that the top support surface extends above the leg panel; top boards respectively having desired shapes and capable of being fastened to the top support surfaces of the top board support members; and longitudinal beams connecting the adjacent leg panels and forming a trough; wherein each of the leg panels is a hollow structure having a cut upper corner, an end part of each longitudinal beam is fastened to the cut upper corner.

Since the top board support members are held on the leg panels and the top boards are attached to the top board support members, the desk system can be formed in a desired form regardless of the plane shape of the top boards, the top boards can be easily rearranged without using any additional parts and using the common parts when the purpose of the desk system is changed. Since the top boards are supported by the top board support members on the leg panels, the height of the top boards from the leg panels can be adjusted simply by adjusting the height of the top board support members from the leg panels, regardless of the construction of the top boards.

Spaces for receiving cables and support rods of screen panels may be formed between the longitudinally adjacent top boards extended between the leg panels and supported on the top board support members and/or between the laterally adjacent top boards.

The desk system may further comprise screen panels provided with support rods to be fixedly inserted in holes formed in top walls of the leg panels. Desk sections for individual persons of the desk system can be separated by the screen panels.

Each of the leg panels has a frame of a metal defining the shape of the leg panel, and a pair of side panels attached to the opposite sides of the frame. Preferably, one of the side panels is detachable from the frame.

The legs of the top plate support members and the support rods of the screen panels attached to the leg panels can be completely concealed for an improved appearance. When the layout of the desk system is changed, the desk system can be disassembled and reassembled simply be removing the side panels.

Preferably, each top board support member is a structure having a shape resembling the inverted letter U in a front elevation and has a pair of legs and a cross beam connecting the upper ends of the pair of legs or a structure having a shape resembling the letter T in a front elevation and has a single leg and a cross beam connected to the upper end of the leg, the upper surface of the cross beam of the top board support member serves as a top board support surface, and the upper wall of the leg panel is provided with openings through which the legs or the leg of the top board support member is inserted in the leg panel and moved for height adjustment.

Preferably, upper end parts of the legs of the top board support member are bent perpendicularly and the cross beam is extended between the free ends of perpendicularly bent upper end parts, the top board is fastened to the upper surface of the cross beam, and a gap for wiring is formed between the adjacent top boards. Even when the top board support members for supporting the adjacent top boards are mounted on the single leg panel, the gap for wiring can be formed between the adjacent top boards.

When the desk system is of a opposed-desk type, leg panel pairs each of the two leg panels joined together with the upper cut parts thereof facing each other so as to form a concave space, the longitudinal beams are attached to the upper cut parts of the leg panels so as to form a trough having a cross section corresponding to that of the concave space to use the trough as a cable trough for wiring. Thus cables can be easily neatly arranged under the top boards in the cable trough, and all the necessary wires and cables can be arranged under the top boards. The longitudinal beams extended between the leg panels and forming the cable trough serve as strengthening members that strengthen the desk system.

Screen panel holding members may be attached to the longitudinal beams having opposite ends fastened to the leg panels, and the support rods of the screen panels may be set upright on the screen panel holding members.

Preferably, the screen panel holding member has an oblique surface of an inclination equal to the inclination of the longitudinal beam attached to the leg panels when the upper truncated part of the leg panel has a bevel surface, a holding projection that engages in an opening formed in the longitudinal beam is formed in an upper end part of the oblique surface, a threaded hole is formed in a lower end part of the oblique surface, and a hole for receiving a support rod for supporting the screen panel is formed in the upper surface of the screen panel holding member.

An upper end part of the support rod for supporting the screen panel may be inserted in a vertical hole formed in the screen panel, and a height adjustment device for adjusting the height of the screen panel may be mounted on the support rod to adjust the height of the screen panel.

The screen panel is formed by forming a fiber panel of regenerated vegetable fibers, such as regenerated bamboo fibers, and a solidifying reclaimed resin, spreading a filler sheet, such as a cotton sheet, over a surface of the fiber panel, covering the filler sheet with a fabric, subjecting the assembly of the fiber panel, the filler sheet and the fabric to hot-pressing to obtain a composite panel, and attaching a frame to the composite panel.

A specific pattern may be formed in the fabric of the screen panel by pressing the fabric with a patterning die.

When the desk system is of an opposed-desk type, the desk system may be provided with double-faced screen panel formed by joining the two composite panels back-to-back with the fabrics facing out to form a build-up panel, and attaching a frame to the built-up panel.

According to a second aspect of the present invention, a built-up desk system capable of being formed in a desired form comprises: a plurality of leg panels; top boards of a desired plane shape attached to the upper-surfaces of the leg panels; top board support members combined with the plurality of leg panels to support the top boards fixedly; and beams connecting the plurality of leg panels and forming a trough; wherein the number of the leg panels is three or above, the number of the top boards supported on the leg panels is two or above, at least the two beams connecting the leg panels are straight; and the middle leg panel supports the two adjacent top boards.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
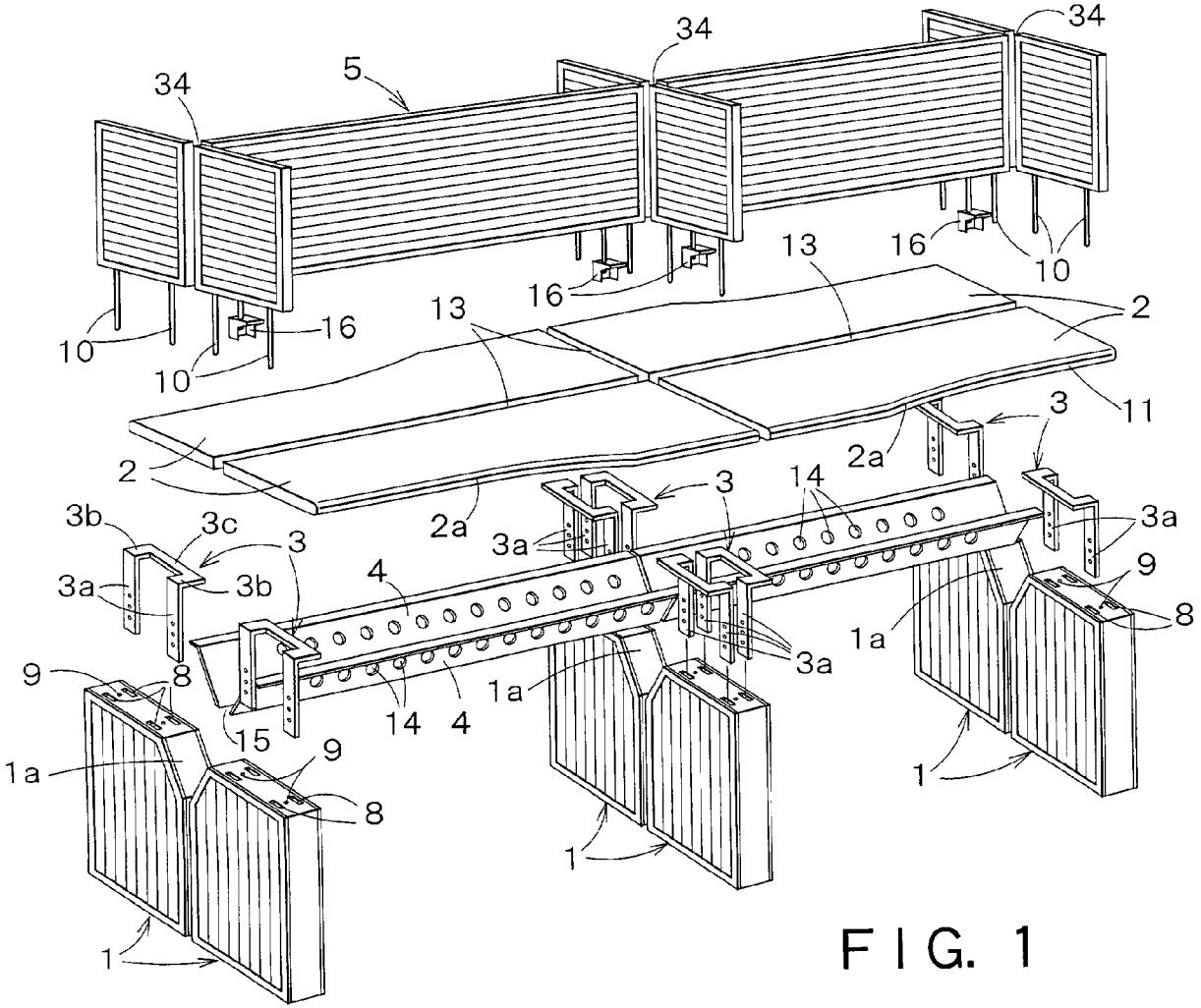
FIG. 1 is an exploded perspective view of an opposite-desk type desk system in a first embodiment according to the present invention.

Referring to FIG. 1, an opposed-desk type desk system in a first embodiment according to the present invention comprises leg panels 1, top boards 2, top board support members 3 for fixedly supporting the top boards 2 on the leg panels 2; beams 4 connecting the leg panels 1 and forming a cable trough, and screen panels 5.

Figure 2:
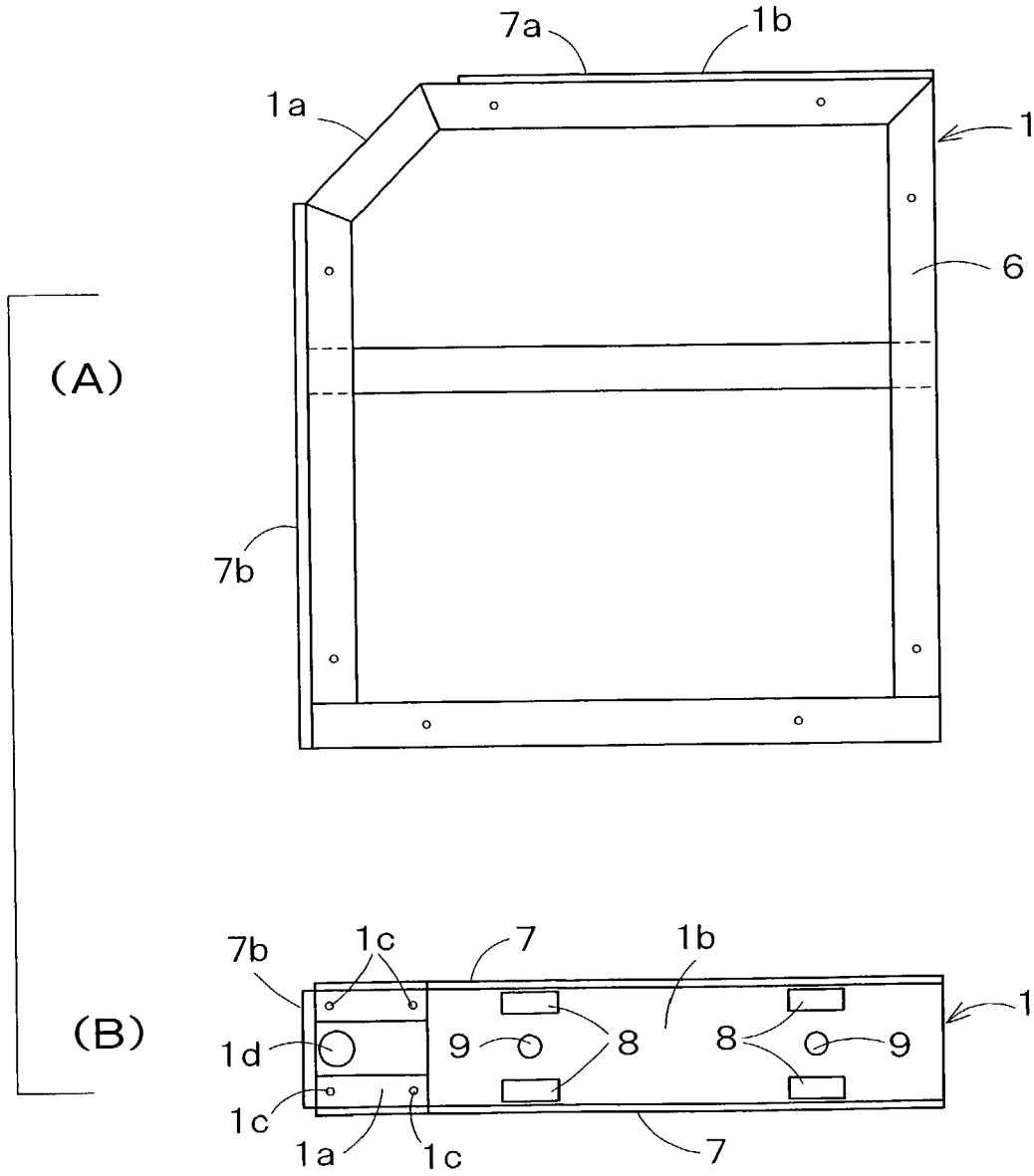
FIGS. 2(A) and 2(B) are a front elevation and a plan view, respectively, of a leg panel included in the desk system shown in FIG. 1, in which side panels are removed.

As shown in FIGS. 1 and 2(A), the leg panels 1 are paired by installing the two leg panels 1 laterally contiguously in a symmetrical shape.

Figure 3:
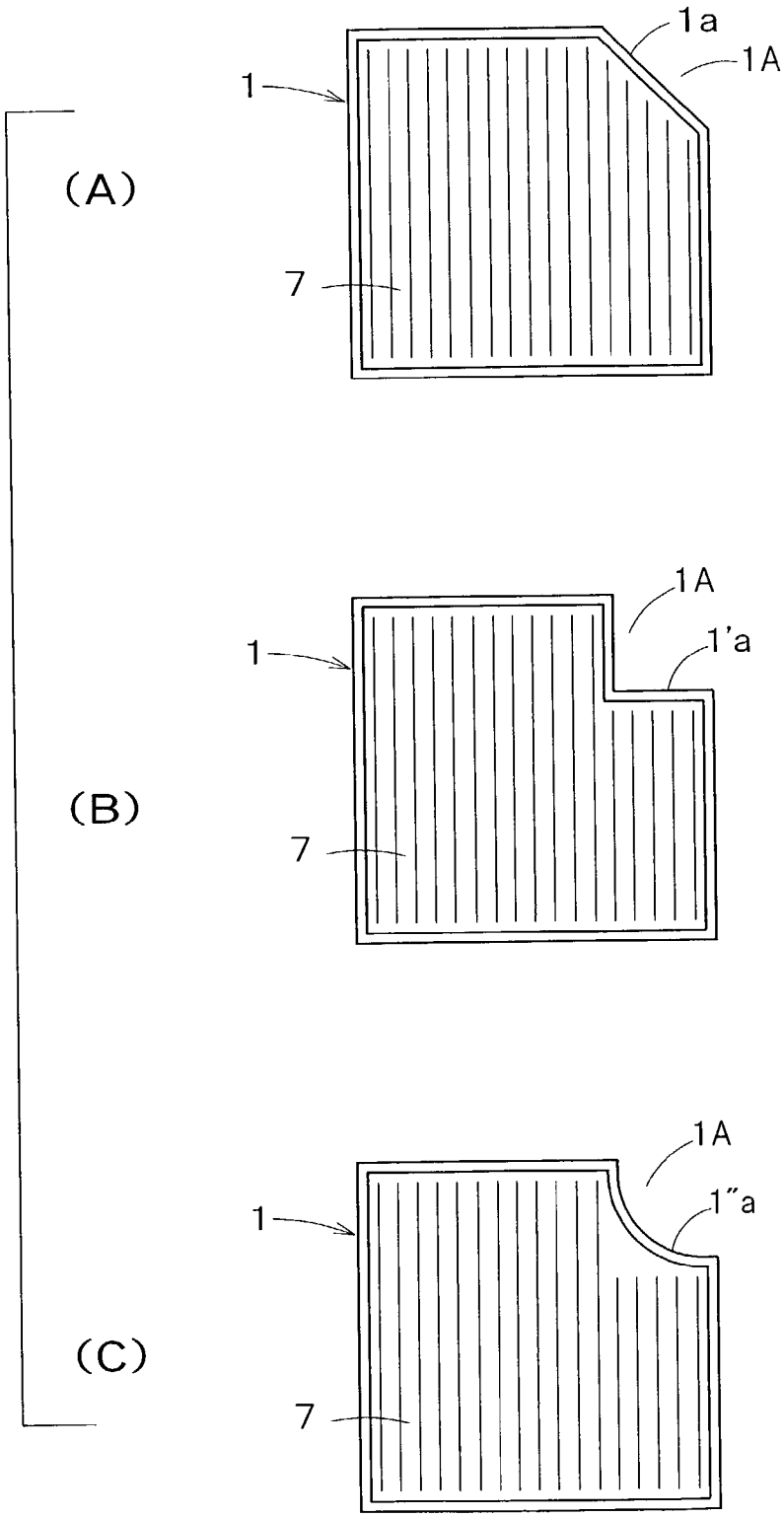
FIGS. 3(A), 3(B) and 3(C) are front elevations of leg panels.

Each leg panel 1 has a predetermined thickness and is formed in a vertically elongate rectangular shape. Opposed upper corners of the pair of leg panels 1 are truncated to form cut corners 1A defined by bevel surfaces 1*a* inclined at about 45° to a horizontal plane. When the pair of leg panels 1 are installed as shown in FIG. 1, the bevel surfaces 1*a* form a V-shaped groove. An upper corner of each leg panel 1 may be cut, instead of being truncated as shown in FIG. 3(A), to form a cut corner 1A defined by an L-shaped surface 1'*a* as shown in FIG. 3(B) or a round surface 1"*a* as shown in FIG. 3(C).

Referring to FIG. 2(A), the leg panel 1 has a steel frame 6, side panels 7 detachably attached to the opposite sides of the frame 6, a decorative panel 7*a* attached to the top surface 1*b* of the horizontal upper member of the frame 6, and a plate 7*b* attached to the outer surface of a vertical frame member extending from the lower end of the bevel surface 1*a*. Two pairs of openings 8 for receiving the pairs of leg parts 3*a* of the top board support members 3, and openings 9 for receiving support rods 10 for supporting the screen panels 5 are formed in the top surface 1*b* of the horizontal upper member of the frame 6.

Formed in the bevel surface 1*a* are two pairs of threaded holes 1*c* formed near the opposite side edges of the bevel surface 1*a*, respectively, and an opening 1*d* formed in a lower middle part to receive a support rod for supporting a shelf, a rack for supporting the display of an OA machine or the like.

Figure 4:
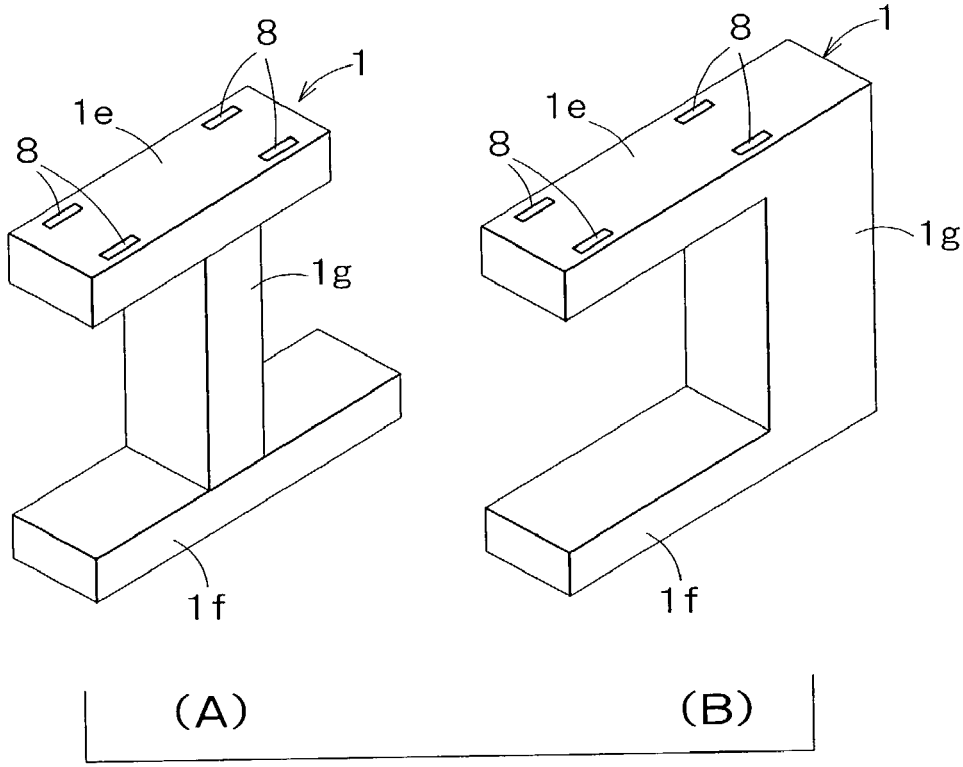
FIGS. 4(A) and 4(B) are perspective views of leg panels in modifications.

An I-shaped leg 1 having a horizontal top bar le, a horizontal bottom bar 1*f*, and a vertical bar 1*g* having opposite ends joined to middle parts of the top bar le and the bottom bar 1*f*, respectively as shown in FIG. 4(A) or a U-shaped leg 1 having a horizontal top bar le, a horizontal bottom bar 1*f*, and a vertical bar 1*g* having opposite ends joined to corresponding end parts of the top bar le and the bottom bar 1*f*, respectively as shown in FIG. 4(B) may be used instead of the foregoing leg panel 1. The leg panel 1 shown in FIG. 2(A), the H-shaped leg 1 shown in FIG. 4(A) or the U-shaped leg 1 shown in FIG. 4(B) is used selectively taking into consideration the design of the desk system.

Figure 5:
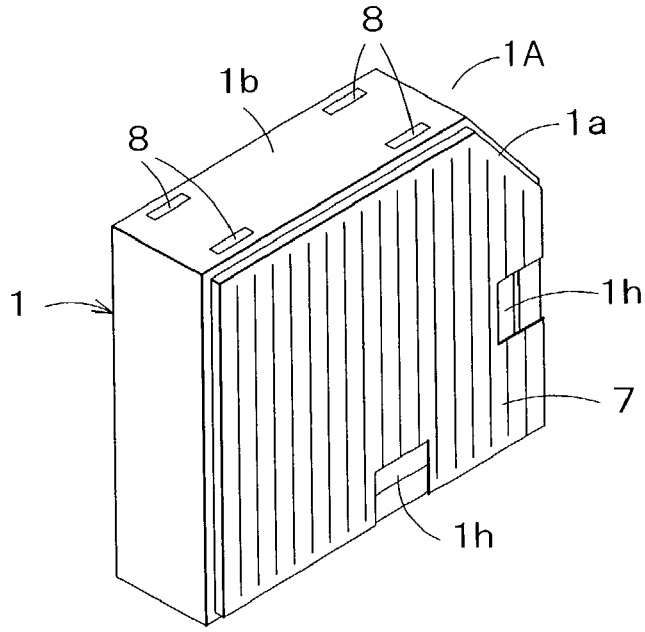
FIG. 5 is a perspective view of the leg panel provided with openings in a side panel thereof.

As shown in FIG. 5, the leg panel 1 is provided with openings (or windows) 1*h* in its side panel 7. Cables are inserted through the openings 1*h* into the hollow leg panel 1.

Figure 6:
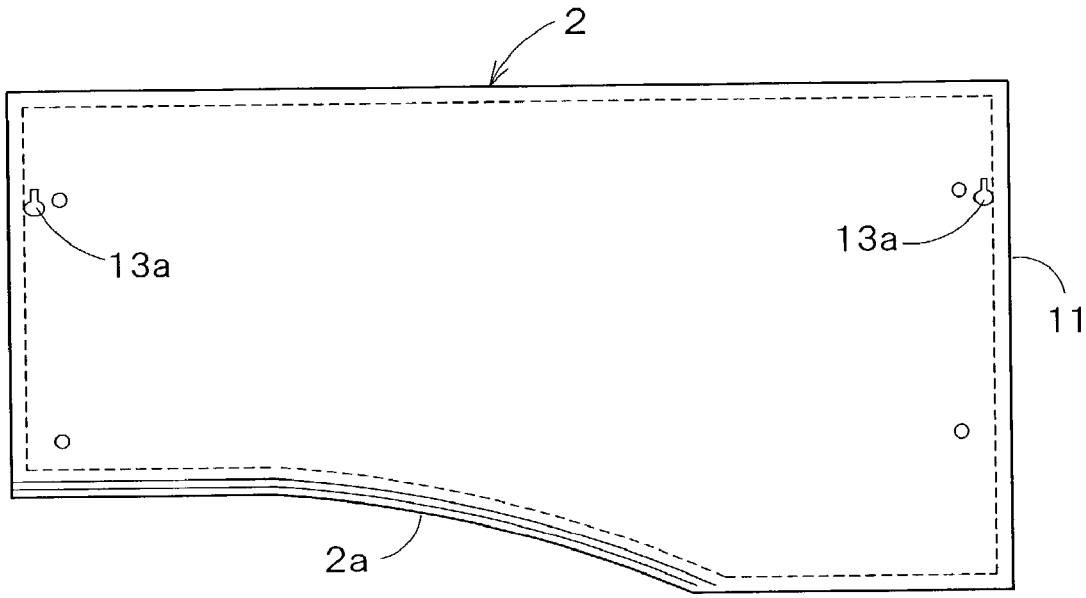
FIG. 6 is a bottom view of one of top boards included in the desk system shown in FIG. 1.

The top board 2 shown in FIG. 6 is a strong, lightweight structure having a flat structure formed by sandwiching a honeycomb core between upper and lower panels, and a decorative frame 11 attached to the side surfaces of the flat structure. The edge 2*a* of a part in front of which a person is stationed for work of the top board 2 is formed in a shape conforming to the layout of the desk system. Thus, the top board 2 is chosen from a plurality of kinds of top boards 2 respectively having different shapes.

The top board support member 3 is formed of aluminum by die casting. In the first embodiment, the top board support member 3 has the shape of the inverted letter U in a front elevation as shown in FIGS. 1, 7, 8 and 9. The top board support member 3 has a pair of vertical leg parts 3*a*, horizontal arm parts 3*b* horizontally extending from the upper ends of the leg parts 3*a*, respectively, and a cross beam 3*c* joined to the extremities of the horizontal arm parts 3*b*.

A plurality of holes 3*d*, three holes 3*d* in this embodiment, are formed in a longitudinal arrangement in each of the leg parts 3*a*. The leg parts 3*a* are inserted in the openings 8 formed in the top surface 1*b* of the leg panel 1, a screw is screwed through one of the holes 3*d* of each leg parts 3*a* in a threaded hole formed in the frame 6 of the leg panel 1 to support the top board 2 at a desired height.

The cross beam 3*c* is provided with threaded holes 12. Screws are screwed through openings formed in the top board 2 in the threaded holes 12 to fasten the top board 2 to the cross beam. It is preferable, with a view to reducing time and labor necessary for assembling the desk system, to provided the cross beam 3*c* with a threaded hole 43 near one end of the cross bar 3*c* and a hole 12 near the other end of the cross beam 3*c*, to screw a headed screw in the threaded hole 43, to form a locking hole 13*a* having a round part that permits the passage of the head of the headed screw in the bottom wall of the top board 2, to engage the head of the headed bolt in the locking hole 13*a* of the top board 2, and to screw a screw through the hole 12 in a threaded hole formed in the top board 2.

The top boards 2 are fastened to the top board support members 3 such that gaps 13 for extending cables for supplying power to OA machines are formed between the laterally adjacent top boards 2 and between the longitudinally adjacent top boards 2.

Figure 7:
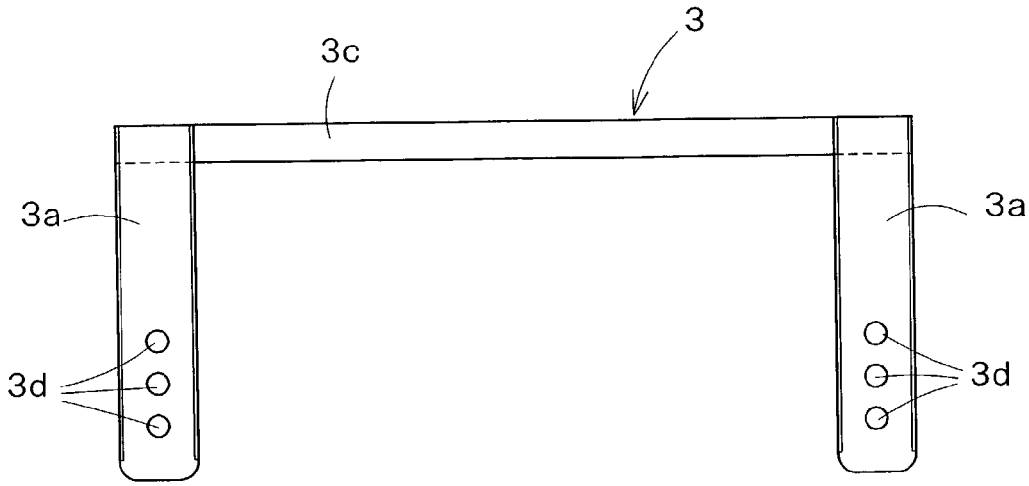
FIG. 7 is a front elevation of a top board support member included in the desk system shown in FIG. 1.
Figure 8:
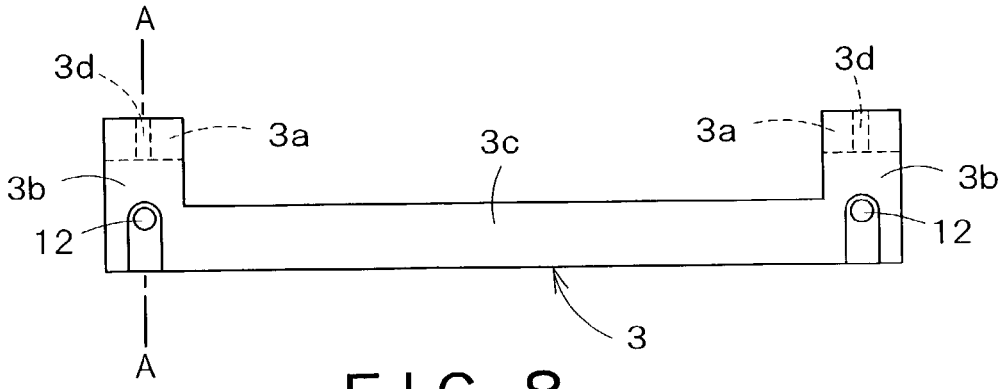
FIG. 8 is a plan view of the top board support member shown in FIG. 7.
Figure 9:
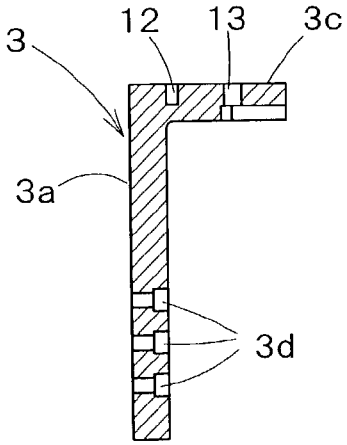
FIG. 9 is a sectional view taken on line A—A in FIG. 8.
Figure 10:
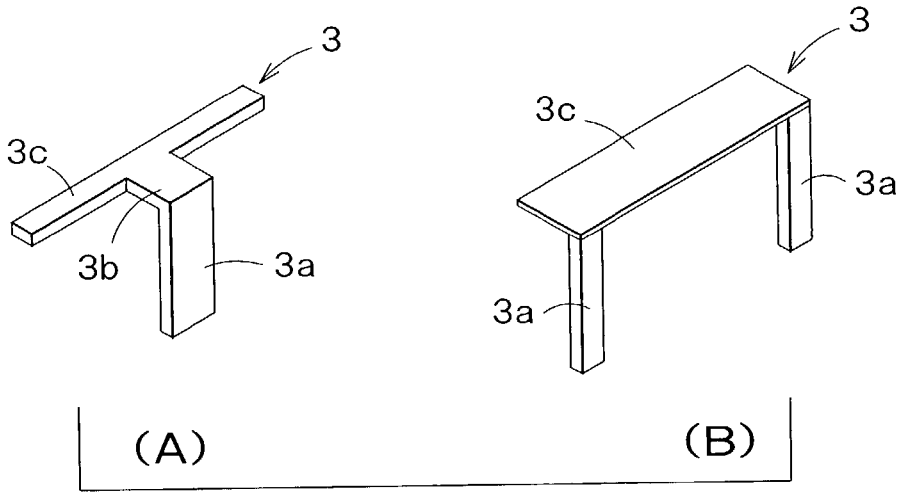
FIGS. 10(A) and 10(B) are perspective views of top board support members in modifications.

A top board support member 3 shown in FIG. 10(A) or FIG. 10(B) may be used instead of the top board support member 3 shown in FIG. 7. The top board support member 3 shown in FIG. 10(A) has a single leg part 3*a*, a horizontal arm part 3*b* joined to the upper end of the leg part 3*a*, and a cross beam 3*c* formed integrally with or attached to the arm part 3*b*, and is formed in a T-shape in a front elevation. The top board support member 3 shown in FIG. 10(B) has two leg parts 3*a*, and a cross beam 3*c* formed integrally with or attached to the upper ends of the two leg parts 3*a*, and is formed in an inverted U-shape in a front elevation.

The beam 4 is an elongate, rectangular metal plate provided with longitudinally arranged wiring holes 14. The beam 4 has a width corresponding to the length of the bevel surface 1*a* of the leg panel 1. When the pair of leg panels 1 are installed in a symmetrical arrangement so that the bevel surfaces 1*a* form a V-shaped groove as shown in FIG. 1, the two beams 4 are set on the opposite bevel surfaces 1*a* to form a cable trough having a V-shaped cross section and having an open bottom 15 as shown in FIG. 1.

Figure 11:
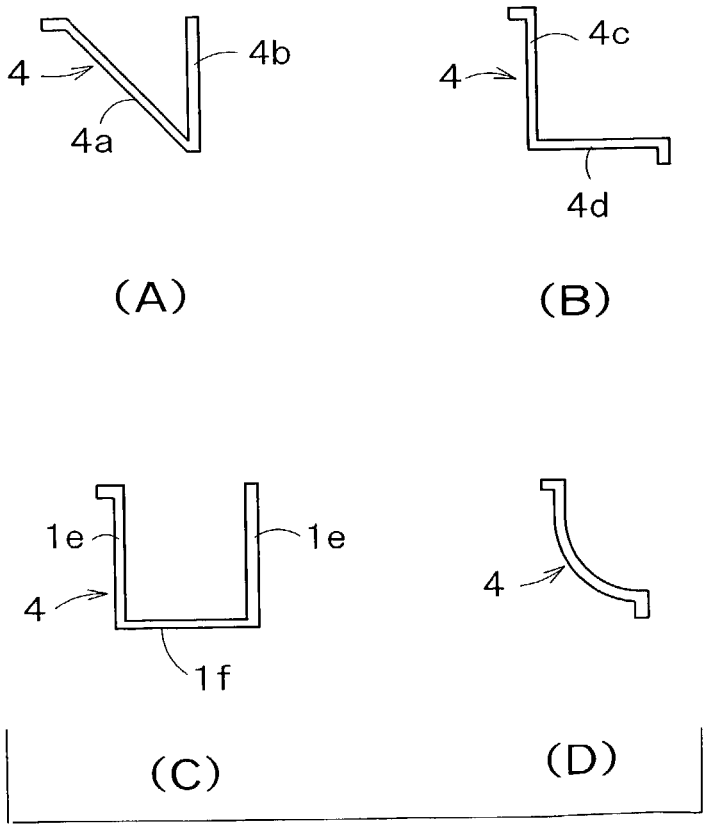
FIGS. 11(A), 11(B), 11(C) and 11(D) are end views of beams to be used in combination with the leg panels shown in FIGS. 3(B) and 3(C)

FIGS. 11(A) to 11(D) are end views of beams 4 in modifications. The beam 4 having a V-shaped cross section shown in FIG. 11(A) is used to provide a cable trough for a desk system in which the leg panels 1 are arranged at intervals in a single row. This beam 4 has an inclined wall 4*a* to be fastened to the bevel surface 1*a* of the leg panel 1, and an upright wall 4*b* for holding cables in the beam 4.

The beam 4 having an L-shaped cross section shown in FIG. 11(B) having a vertical wall 1*c* and a horizontal wall 1*d* is used to provide a cable trough for a desk system in which the leg panels 1 shown in FIG. 3(B) are used in pairs and are arranged at intervals in two rows. The beam 4 having a U-shaped cross section shown in FIG. 11(C) having vertical walls 4*e* and a bottom wall 4*f* is used to provide a cable trough for a desk system in which the leg panels 1 shown in FIG. 3(C) are arranged at intervals in a single row. The beam 4 having a quadrantal cross section shown FIG. 11(D) is used to provide a cable trough for a desk system in which the leg panels 1 shown in FIG. 3(C) are used in pairs and are arranged at intervals in two rows.

FIGS. 12 to 15 show a single-row working desk system in a second embodiment according to the present invention. The desk system comprises two leg panels 1, a single beam 4, a single top board 2, a single screen panel 5, screen panel holding members 16 for holding the screen panel 5 on the beam 4, and height adjusting devices 17 for adjusting the height of the screen panel 5. The height adjusting device 17 can be used for adjusting the height of the screen panels 5 of the opposed-desk type desk system shown in FIG. 1.

The opposite ends of the beam 4 are fastened to the bevel surfaces 1*a* of the two leg panels 1 with screws, and the screen panel holding members 16 are attached to lower parts near the lower edge of the beam 4.

Figure 13:
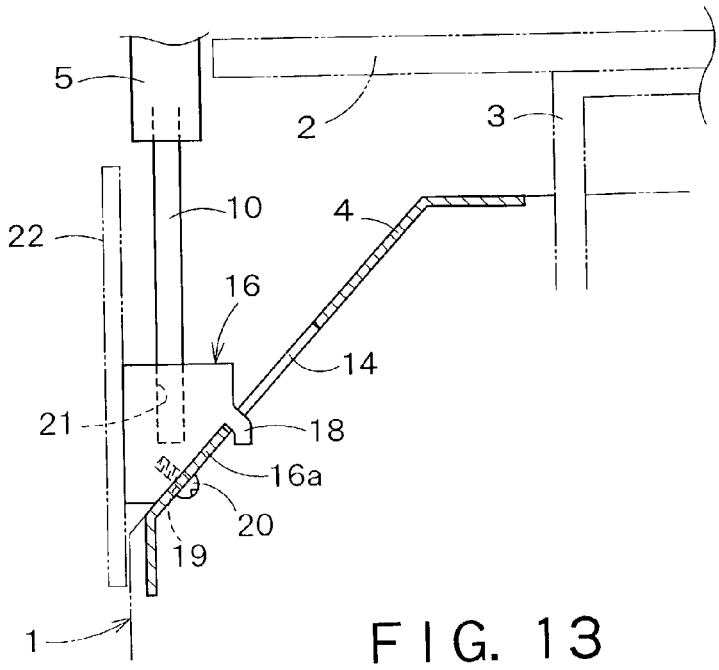
FIG. 13 is a sectional view of a screen panel support structure.

Referring to FIG. 13, the screen panel holding member 16 is a polygonal block having an oblique surface 16*a* inclined at an angle equal to the inclination of the beam 4. The screen panel holding member 16 is provided with a retaining projection 18 projects from an upper end part of the oblique surface 16*a*, and a threaded hole in a lower end part of the oblique surface 16*a*. The retaining projection 18 is engaged in one of the openings 14 of the beam 4, and a screw 20 is screwed in the threaded hole to fasten the screen panel holding member 16 to the beam 4.

The screen panel holding member 16 is provided in its upper surface with a hole 21 for receiving a support rod 10 for supporting the screen pane 15. A cover plate 22 is attached to the vertical side surface of the screen panel holding member 16 to form a cable trough together with the beam 4, and to conceal the beam 4 and the support rod 10 supporting the screen panel 5.

Figure 12:
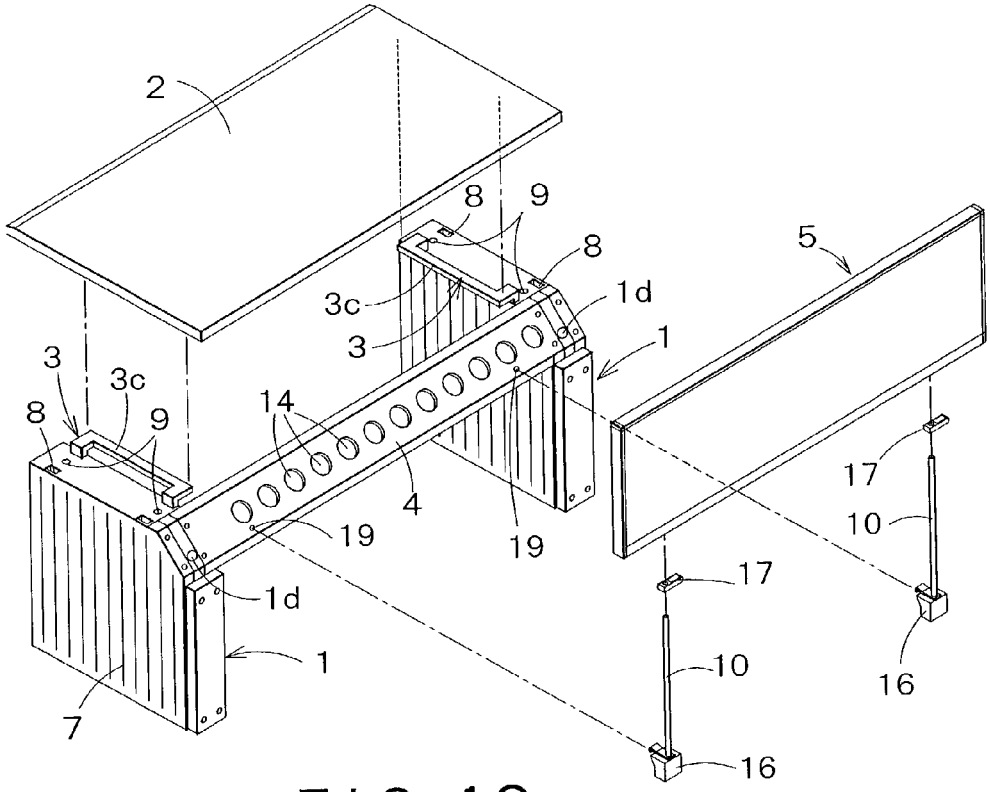
FIG. 12 is an exploded perspective view of a desk system in a second embodiment according to the present invention.
Figure 14:
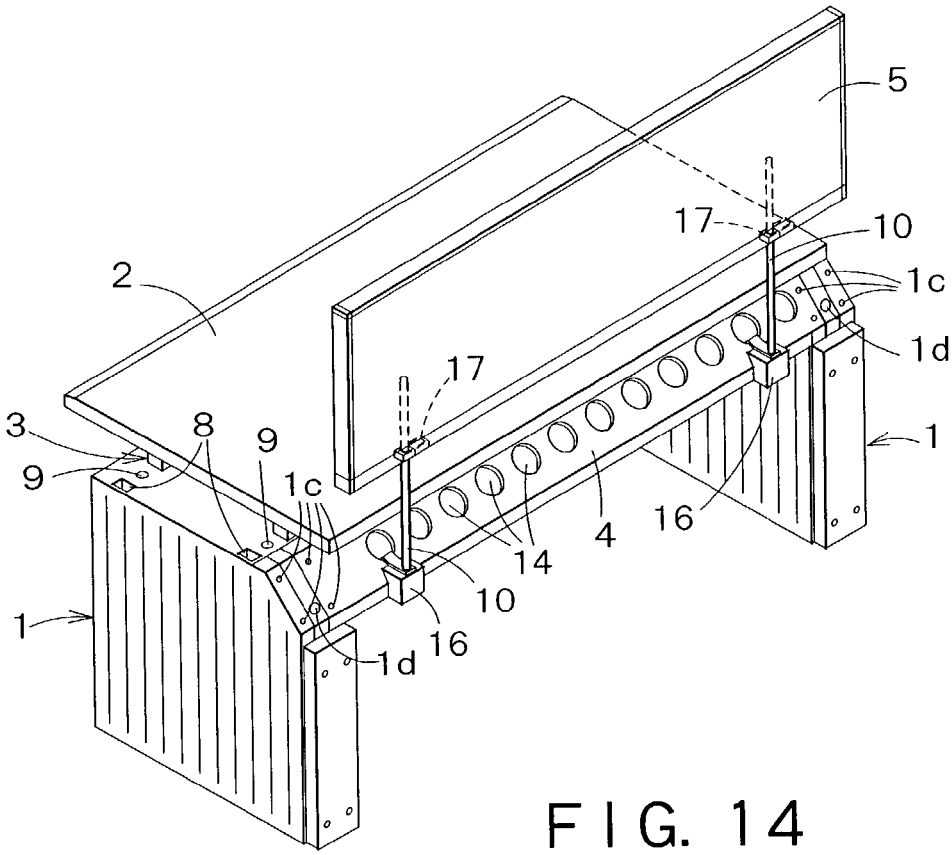
FIG. 14 is a perspective view of the desk system shown in FIG. 12, in which a screen panel is raised to its high position.
Figure 15:
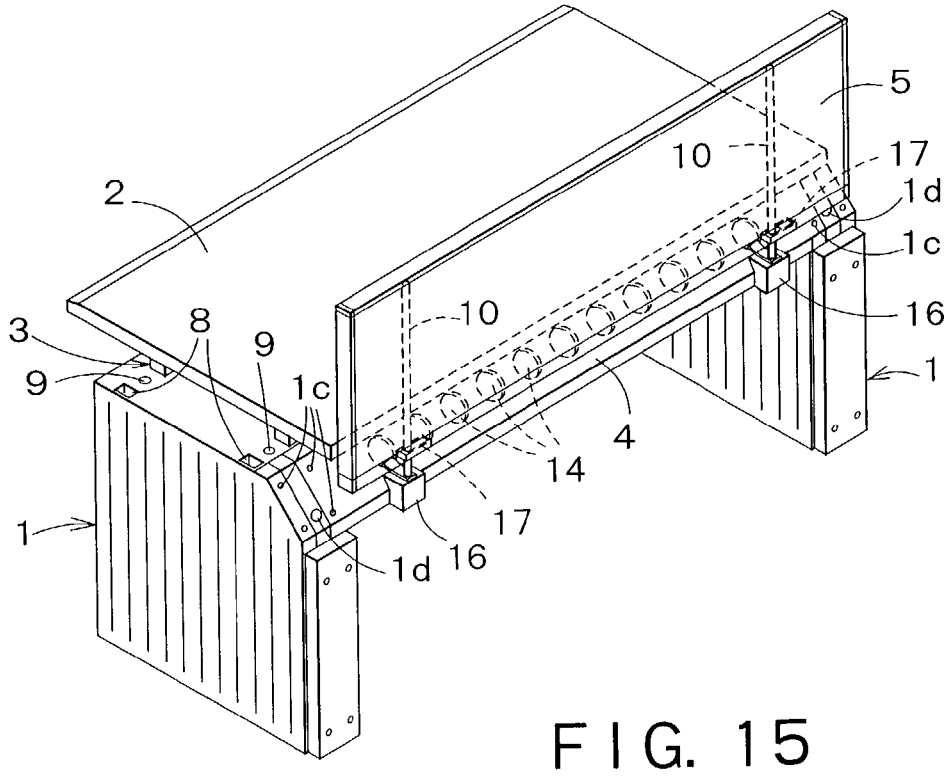
FIG. 15 is a perspective view of the desk system shown in FIG. 12, in which a screen panel is lowered to its low position.
Figure 18:
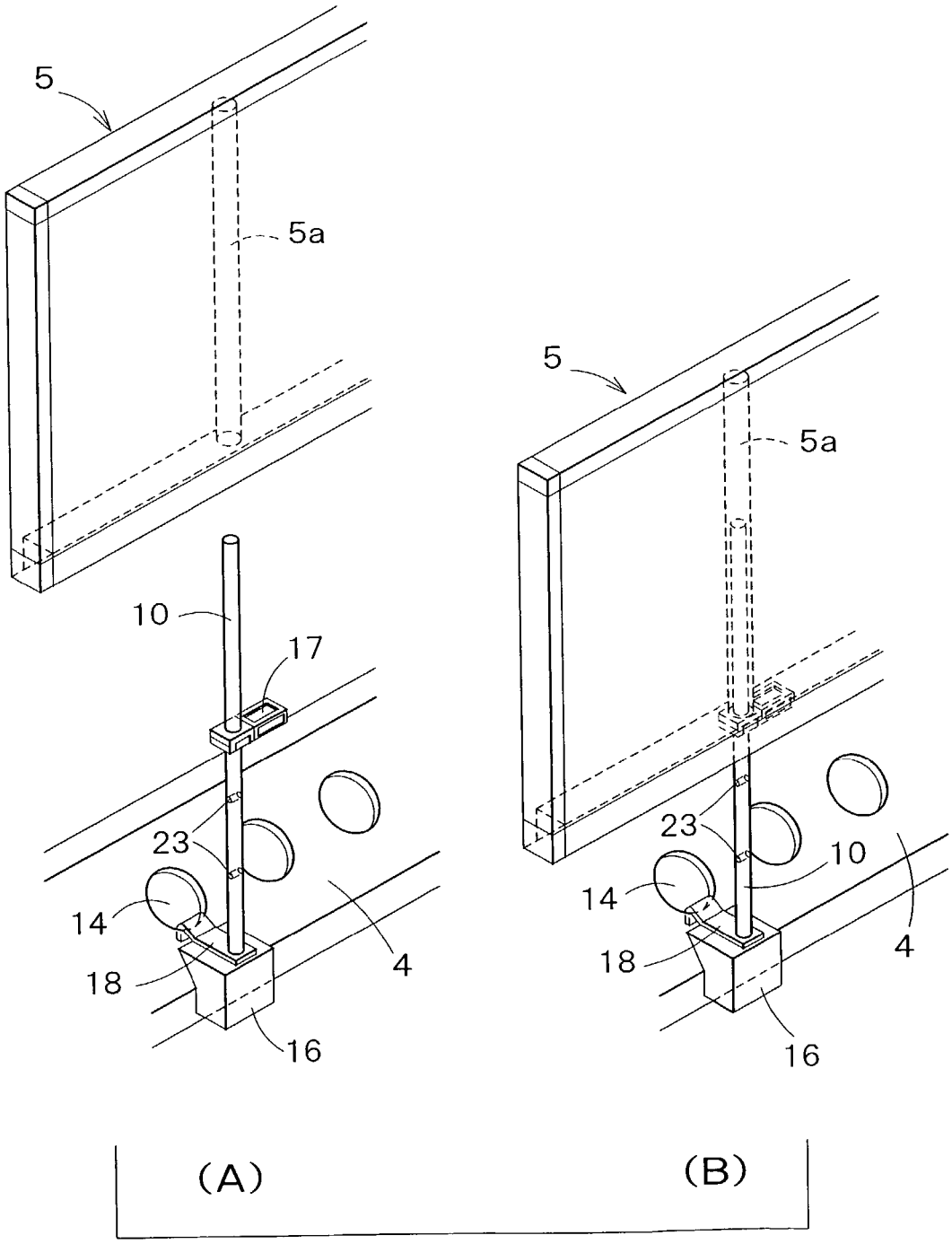
FIGS. 18(A) and 18(B) are fragmentary perspective views of a screen panel before and after installation.

FIG. 14 shows the desk system shown in FIG. 12 in a state where the screen panel 5 is raised to its high position, and FIG. 15 shows the desk system shown in FIG. 12 in a state where the screen panel 5 is lowered to its low position. As shown in FIG. 18, the support rod 10 is provided with a plurality of longitudinally arranged through holes 23 for height adjustment. An upper end part of the support rod 10 is inserted in a hole 5*a* formed in the screen panel 5 to hold the screen panel 5 at a desired height.

Figure 16:
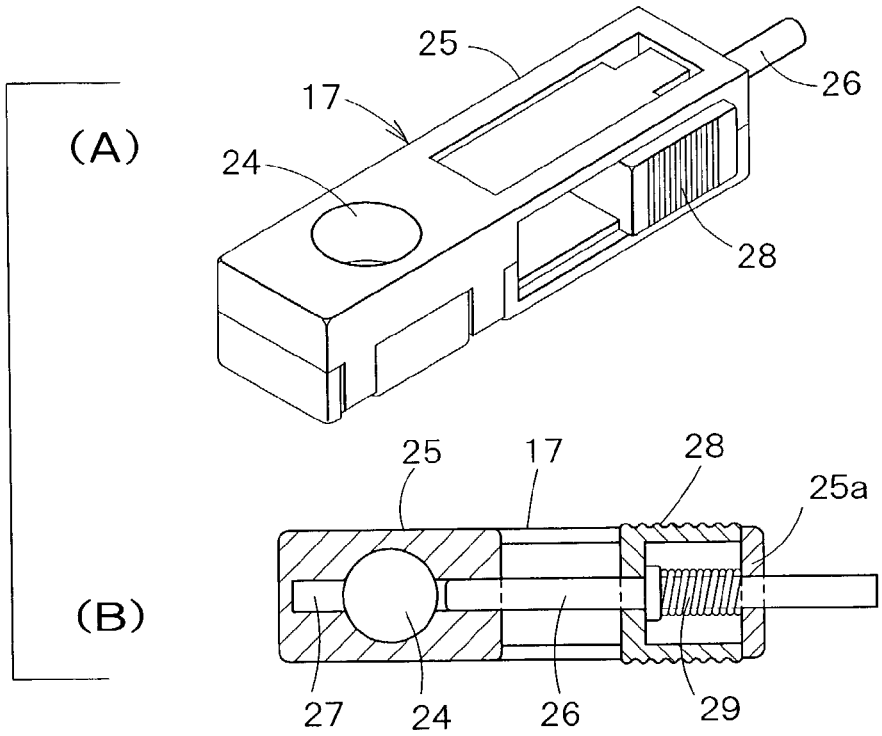
FIGS. 16(A) and 16(B) are a perspective view and a sectional view, respectively, of a height adjusting device for adjusting the height of a screen panel.
Figure 17:
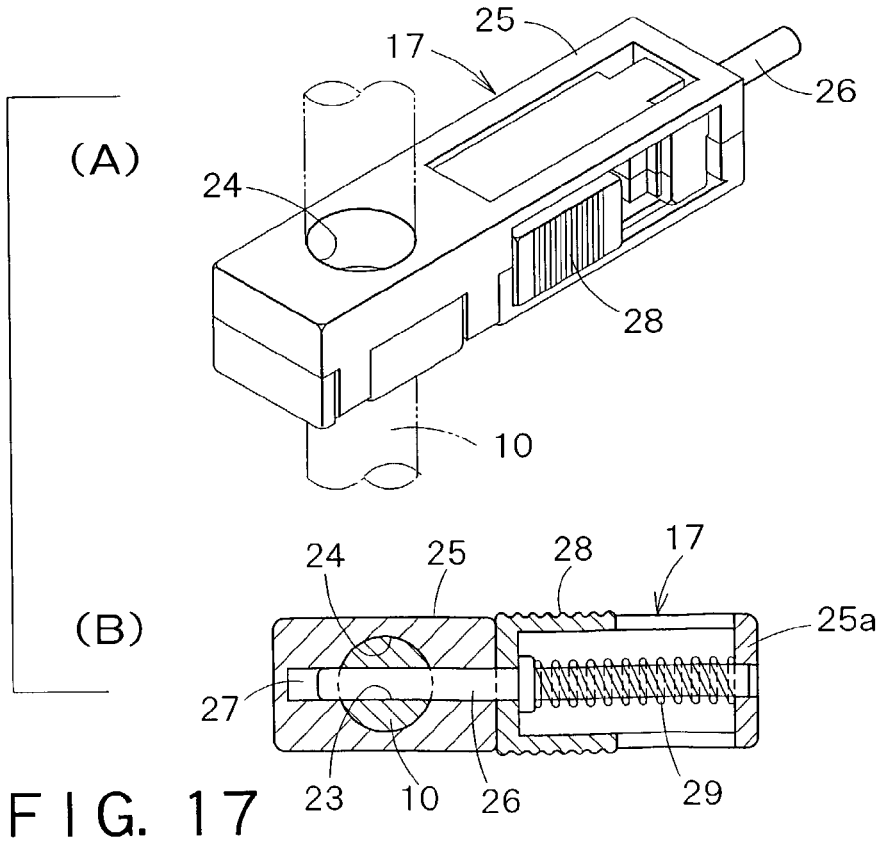
FIGS. 17(A) and 17(B) are a perspective view and a sectional view, respectively, of the height-adjusting device shown in FIGS. 16(A) and 16(B) in use.

FIGS. 16 and 17 show the height adjusting device 17 for adjusting the height of the screen panel 5. The height adjusting device 17 has a body 25 having the shape of an elongate rectangular solid and provided with a vertical hole 24 through which the support rod 10 supporting the screen panel 5 is extended vertically in one end part thereof and a horizontal hole 27 extending diametrically across the vertical hole 24, a locking bolt 26 axially slidably fitted in the horizontal hole 27, a knob 28 attached to a idle part of the locking bolt 26, and a compression spring 29 extended between an end wall of the knob 28 and an end wall of the body 25 to push the locking bolt 26 into the height adjusting hole 23 of the support rod 10 extended through the vertical hole 24.

When the knob 28 is pulled toward the end wall 25*a* against the resilience of the compression spring 29, the locking bolt 26 is extracted from the height adjusting hole 23 as shown in FIG. 16(B), so that the height adjusting device 17 is able to move along the support rod 10 to adjust the height of the screen panel 5. When the knob 28 is released, the locking bolt 26 is inserted in the height adjusting hole 23 of the support rod 10 as shown in FIG. 17(B), so that the height adjusting device 17 is unable to move relative to the support rod 10. The lower end of the screen panel 5 rests on the height adjusting device 17 and is held in place as shown in FIG. 18(B).

Figure 19:
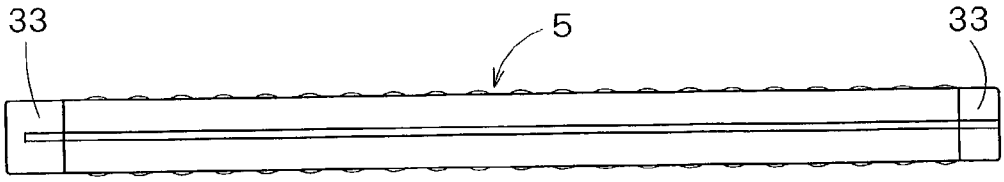
FIG. 19 is a plan view of a screen panel according to the present invention.
Figure 20:
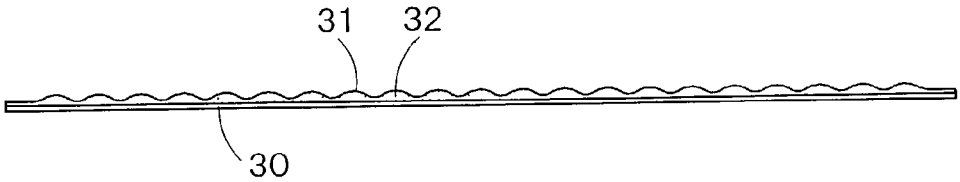
FIG. 20 is a plan view of one of opposite sides of the screen panel shown in FIG. 19.
Figure 21:
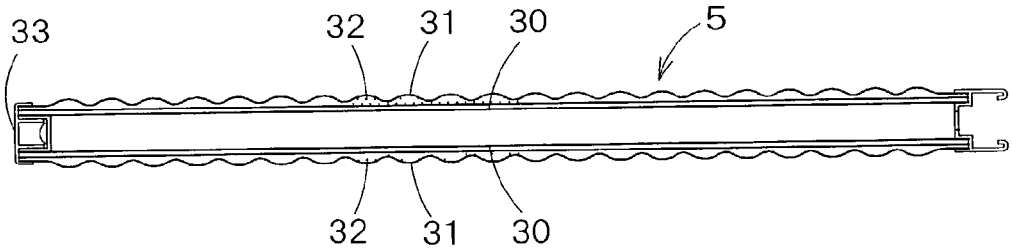
FIG. 21 is a sectional view of the screen panel shown in FIG. 19.

FIGS. 19 and 21 show the screen panel 5 provided with two side panels shown in FIG. 20. As shown in FIG. 20, the side panel of the screen panel 5 has a base plate 30 of a size substantially corresponding to the size of the screen panel 5, a surface layer 31 covering the outer surfaces of the base plate 30, and a padding layer 32 formed by packing padding in a space between the base plate 30 and the surface layer 31. The base plates 30 are formed by solidifying a mixture of regenerated bamboo fibers and a resin, the surface layers 31 are fabrics, and the padding layer 32 is cotton. The layered base plate 30, the surface layer 31 and the padding 32 are compressed by press work in a flat shape. The surface of the surface layer 31 is embossed in a wavy shape. The surface of the surface layer 31 may be formed in an optional shape.

The screen panel 5 is lightweight and excellent in shape retention and sound absorption, has a high strength, permits pinning, and facilitates disposal.

The screen panel 5 shown in FIGS. 19 and 21 is used in the opposite-desk type desk system as shown in FIG. 1. The screen panel 5 is constructed by placing the side panels each consisting of the base plate 30, the surface layer 31 and the padding 32 opposite to each other with a predetermined space formed between the base plates 30, and fixedly attaching a decorative frame 33 to the side panels.

When the screen panels 5 are used in the working desk system shown in FIG. 1 including the plurality of top boards 2, wiring spaces 34 are formed between the adjacent screen panels 5.

Figure 22:
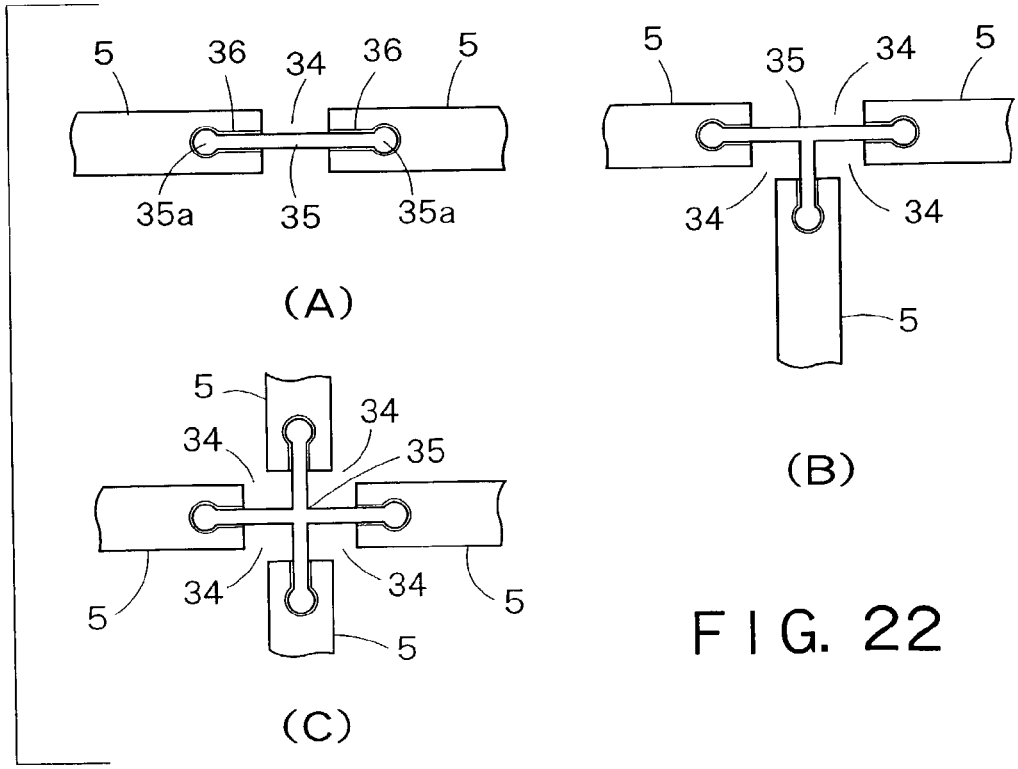
FIGS. 22(A), 22(B) and 22(C) are plan views of screen panel connectors for connecting two screen panels, three screen panels and four screen panels, respectively.
Figure 23:
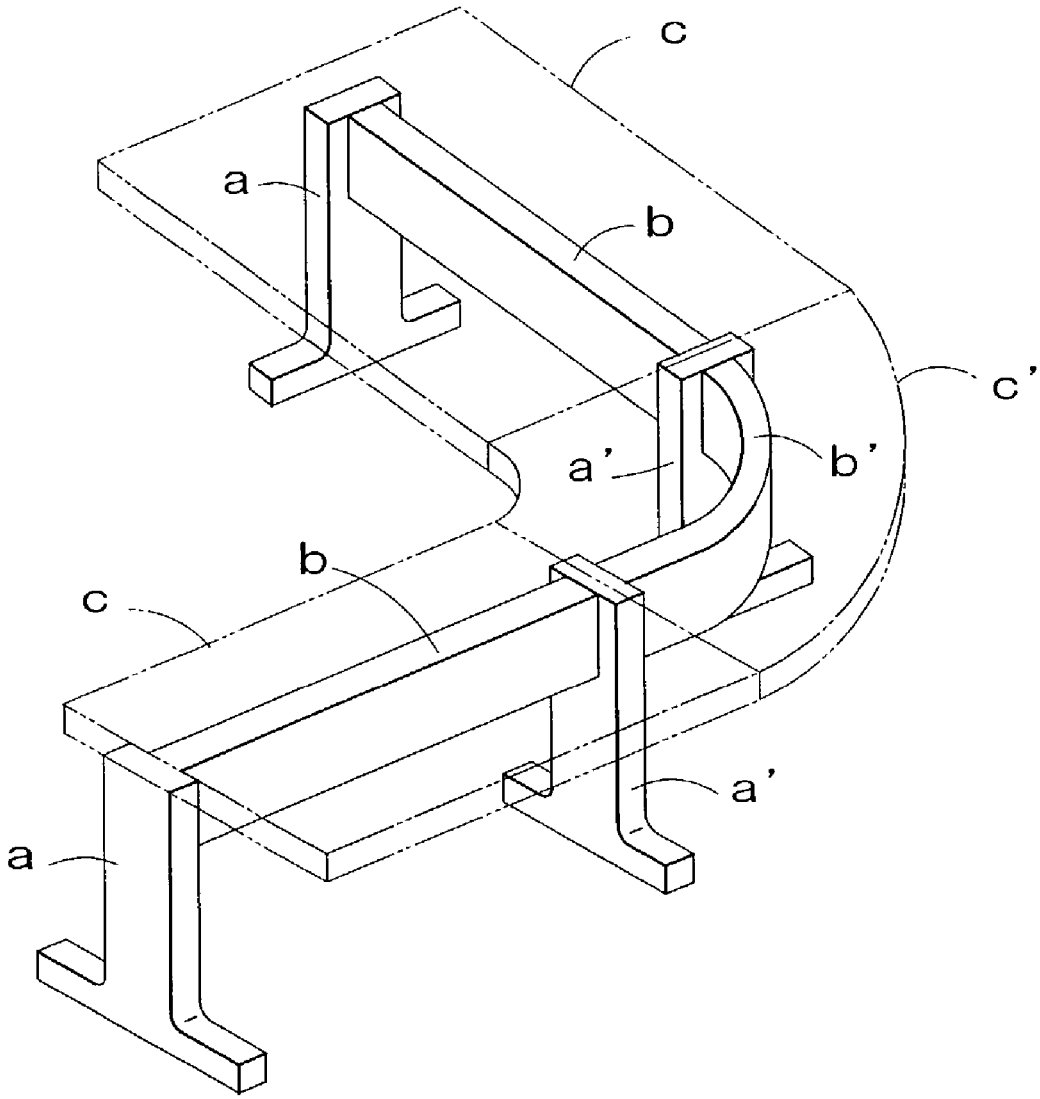
FIG. 23 is a perspective view of a conventional desk system.

FIGS. 22(A), 22(B) and 22(C) show screen panel connectors for connecting the screen panels 5 such that the wiring gaps 34 are formed between the adjacent screen panels 5. A screen panel connector 35 shown in FIG. 22(A) has a straight part and round heads 35*a* formed on the opposite ends of the straight part, and is used for connecting the two laterally arranged screen panels 5. The round heads 35*a* are fitted in grooves 36 formed in end parts of the screen panels 5 to connect the screen plates 5 so that the wiring gap 34 is formed between the screen panels.

A screen panel connector 35 shown in FIG. 22(B) has a T-shape in a plan view and is used for connecting three screen panels 5 extending in three directions, respectively. A screen panel connector 35 shown in FIG. 22(C) has a cross-shape in a plan view and is used for connecting four screen panels 5 extending in four directions, respectively.

Assembling procedures for assembling the desk systems in the preferred embodiments will be described.

When the opposed-desk type desk system shown in FIG. 1 is assembled, the frames 6 of the leg panels 1 of each of the three pairs each of the symmetrically combined leg panels 1 are fastened together with screws to combine the pair of leg panels 1 in a single leg. The beams 4 are fastened to the pairs of the leg panels 1 to connect the pairs of leg panels 1.

The leg parts 3*a* of the top board support members 3 are inserted in the holes 8 formed in the top surfaces 1*b* of the horizontal upper members of the frames 6, the top board support members 3 are held at a desired height, and screws are screwed through the holes 3*d* corresponding to the desired height in the threaded holes formed in the frames 6 to fasten the top board support members to the leg panels 1.

Then, the top boards 2 are fastened to the cross beams 3*c* of the top board support members 3 with the headed screws and the screws.

Since the cross beam 3*c* of each top board support member 3 is shifted horizontally by a distance corresponding to the length of the horizontal arm parts 3*b* from a position corresponding to the leg parts 3*a*, the wiring gap 13 is formed automatically between the adjacent top boards 2.

If it is desired to set the different top boards 2 at different levels, the top board support members 3 supporting those top boards 2 are set at different heights, respectively.

When the screen panels 5 are used, the support rods 10 are inserted in the holes 9 of the leg panels 1, the screen panel holding members 16 are fastened to the beams 4, the height adjusting devices 17 are positioned properly on the support rods 10 to locate the screen panels 5 at a desired height.

In the single-row working desk system shown in FIGS. 12 to 15, the leg panels are installed with the bevel surfaces 1*a* thereof facing back, the opposite ends of the beam 4 are fastened to the bevel surfaces 1*a*, respectively, with screws.

The top board support members 3 are attached to the leg panels 1, and the top board 2 is attached to the top board support members 3 by the foregoing procedure. When the screen panel 5 is needed, the screen panel holding members 16 are fastened to the beam 4, the support rods 10 are set on the screen panel holding members 16, the height of the height adjusting devices 17 on the support rods 10 is determined, and then the screen panel 5 is put on the support rods 10.

When a shelf is needed, the shelf can be simply supported on the leg panels 1 by inserting support rods for supporting the shelf through the gap 13 between the top boards 2 in holes 1*d* formed in the bevel surfaces 1*a* of the leg panels 1, and putting the shelf on the support rods.

When the desk system needs to be disassembled or the layout of the desk system needs to be changed, the steps of the foregoing assembling procedure are reversed.

As apparent from the foregoing description, according to the present invention, the desk system can be constructed in an optional layout regardless of the plane shape of the top boards, and the combination of the top boards can be changed by using the common parts when uses of the desk system requires because the top board support members are attached to the leg panels and the top boards are attached to the top board support members. Since the top boards are held by the top board support members on the leg panels, the height of the top boards from the leg panels can be adjusted simply by changing the vertical positions of the top board support members on the leg panels. Thus, the height of the top boards can be easily adjusted regardless of the construction of the top boards.

Sections of the desk system for persons stationed opposite to each other and those stationed side by side can be separated from each other by fixedly inserting the support rods in the holes formed in the upper ends of the leg panels, and supporting the screen panels on the support rods.

Since the leg parts of the top board support members attached to the leg panels and the support rods supporting the screen panels can be completely concealed by the cover plates 22, the desk system has an improved appearance. Work for changing the layout of the desk system can be performed simply by removing the cover plates.

Since the end parts of the adjacent top boards are supported on the single leg panel, the number of the leg panels necessary for supporting the plurality of top boards is small, the desk system has a simple appearance, the numbers of the necessary parts is small and, hence, the desk system can be fabricated at a low cost.

The gaps between the top boards facilitate the arrangement of cables for supplying power to OA machines to be operated on the desk system, and the installation of the support rods for supporting the screen panels on the leg panels.

The top board support members can be easily attached to the leg panels by inserting the leg parts of the top board support members in the holes formed in the upper end surfaces of the leg panels and fastening the same to the leg panels, and the height of the top boards can be easily adjusted by adjusting the depth of insertion of the leg parts of the top board support members in the holes of the leg panels.

The gap between the adjacent top boards can be easily formed by supporting the adjacent top boards by the top board support members on the single leg panel.

In the opposed-desk type desk system, the two paired leg panels are disposed with the upper cut parts thereof facing each other so as to form the concave space, and the beams are attached to the upper cut parts of the leg panels so as to form the cable trough in the concave space. The cable trough enables efficient work for laying cables, and the beams extended between the leg panels and forming the cable trough serve as strengthening members that strengthen the desk system.

The screen panels can be incorporated into the single-row desk system.

The screen panels are lightweight and strong, have a soft appearance, permit pinning, are satisfactorily capable of sound absorption, and facilitate disposal.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A desk system capable of being assembled in a desired form comprising:

a pair of leg panels, each leg panel being formed as a hollow structure of a desired thickness and having a cut upper corner, the cut upper corner being angled downwardly with respect to an upper wall and being angled inwardly with respect to an end wall of each of the leg panels, the pair of leg panels being spaced apart from each other;

top board support members each having a top support surface and capable of being fastened to a respective one of the leg panels such that the top support surface extends above the respective leg panel;

top boards respectively having desired shapes and capable of being fastened to the top support surfaces of the top board support members fastened to each of the leg panels; and a longitudinal beam connecting the pair of leg panels;

wherein opposite end parts of the longitudinal beam are fastened to the cut upper corners of the pair of leg panels.

2. The desk system according to claim 1, wherein each of the leg panels has a frame defining the shape of the leg panel, and a pair of side panels attached to the opposite sides of the frame, and at least one of the side panels is detachable from the frame.

3. The desk system according to claim 2, wherein the side panels are provided with at least one cable passing opening.

4. The desk system according to claim 1, wherein the cut upper corner of each leg panel has a bevel surface formed by truncating a square corner, an L-shaped surface formed by cutting out a rectangular part from a square corner, or a round surface formed by cutting out a quadrantal part from a square corner.

5. The desk system according to claim 1, wherein each of the leg panels is a self-supporting structure having an I-shape in a front elevation and comprising a horizontal top bar, a horizontal bottom bar, and a vertical bar having opposite ends joined to middle parts of the top bar and the bottom bar, respectively, or a self-supporting structure having a U-shape and comprising a horizontal top bar, a horizontal bottom bar, and a vertical bar having opposite ends joined to corresponding end parts of the top bar and the bottom bar, respectively.

6. The desk system according to claim 1, wherein adjacent end parts of the longitudinally adjacent top boards are held on the single leg panel.

7. The desk system according to claim 1, wherein gaps through which cables and screen panel support rods are extended are formed between the longitudinally adjacent and/or the laterally adjacent top boards extended between the leg panels and supported on the top board support members.

8. The desk system according to claim 1, wherein each top board support member is provided with a plurality of holes to be used for fastening the top board to the top board support member, and one of the plurality of those holes is used selectively to adjust a gap between the adjacent top boards.

9. The desk system according to claim 1, wherein each top board support member is a structure having a shape resembling the inverted letter U in a front elevation and has a pair of legs and a cross beam connecting the upper ends of the pair of legs or a structure having a shape resembling the letter T in a front elevation and has a single leg and a cross beam connected to the upper end of the leg, and an upper surface of the cross beam of the top board support member serves as a top board support surface.

10. The desk system according to claim 9, wherein upper end parts of the legs of the top board support member are bent perpendicularly and the cross beam is extended between the free ends of perpendicularly bent upper end parts, and an end part of the top board is seated on and fastened to the upper surface of the cross beam, and a gap is formed between the adjacent top boards.

11. The desk system according to claim 1, wherein the upper wall of each leg panel is provided with openings through which the legs or the leg of the top board support member is inserted in the leg panel and moved for height adjustment.

12. The desk system according to claim 1, wherein the desk system is an opposed-desk system, wherein the pair of leg panels of one desk oppose the pair of leg panels of a second desk, the opposing leg panels being joined together with the cut upper corners thereof facing each other so as to form a concave space, and the longitudinal beam attached to the cut upper corners of the leg panels of each of the two desks forming a trough having a cross section corresponding to that of a concave space to connect the opposing leg panels of the two desks.

13. The desk system according to claim 1, wherein holes for receiving support rods for supporting a screen panel are formed in an upper wall of each leg panel, the support rods are inserted through the gap between the top boards in the holes of the upper wall of the leg panel, and a screen panel is supported in an upright position on the support rods.

14. The desk system according to claim 1, wherein screen panel holding members are attached to the beam having opposite ends fastened to the cut upper corners of the leg panels, and the support rods for supporting the screen panel are set upright on the screen panel holding members.

15. The desk system according to claim 14, wherein, when the cut upper corners of the leg panels are bevel surfaces, the screen panel holding member has an oblique surface inclined to a horizontal plane at an inclination equal to an inclination of the longitudinal beam attached to the bevel surfaces of the leg panels, a holding projection that engages in an opening formed in the beam is formed in an upper end part of the oblique surface, a threaded hole is formed in a lower end part of the oblique surface, and a hole for receiving the support rod for supporting the screen panel is formed in an upper surface of the screen panel holding member.

16. The desk system according to claim 13 or 14, wherein upper end parts of the support rods for supporting the screen panel are inserted in vertical holes formed in the screen panel to support the screen panel, height adjusting devices for adjusting the height of the screen panel are mounted on the support rods, and respective positions of the height adjusting devices on the support rods are adjustable.

* * * * *